US010190347B2

(12) United States Patent
Batistakis

(10) Patent No.: US 10,190,347 B2
(45) Date of Patent: Jan. 29, 2019

(54) HINGE PROTECTOR

(71) Applicant: Paul Batistakis, Toronto (CA)

(72) Inventor: Paul Batistakis, Toronto (CA)

( * ) Notice: Subject to any disclaimer, the term of this patent is extended or adjusted under 35 U.S.C. 154(b) by 0 days.

(21) Appl. No.: 15/635,306

(22) Filed: Jun. 28, 2017

(65) Prior Publication Data

US 2019/0003225 A1 Jan. 3, 2019

(51) Int. Cl.
*E05D 11/00* (2006.01)

(52) U.S. Cl.
CPC ..... *E05D 11/0054* (2013.01); *E05Y 2900/132* (2013.01); *Y10T 16/533* (2015.01)

(58) Field of Classification Search
CPC ..... E05D 11/0054; E05D 2011/0063; E05D 2011/0072; E05Y 2900/132; Y10T 16/533; Y10T 16/5335
USPC ..... 16/250, 251; 49/398
See application file for complete search history.

(56) References Cited

U.S. PATENT DOCUMENTS 5,722,120 A * 3/1998 Bindschatel ..... E05D 11/0054 16/250
2002/0129464 A1* 9/2002 Davis ..... E05D 11/0054 16/250
2005/0155725 A1* 7/2005 Verheye, Sr. ..... E05D 11/0054 160/229.1
2008/0244867 A1* 10/2008 Tuell ..... E05D 11/00 16/250
2016/0076287 A1* 3/2016 Sandoval ..... B05B 12/24 16/250

OTHER PUBLICATIONS www.propaintingproducts.com/products/hinge-mask, printed on Nov. 15, 2017, 2 pages.

* cited by examiner

*Primary Examiner* — William L Miller
(74) *Attorney, Agent, or Firm* — Moss & Barnett; Michael A. Bondi

(57) ABSTRACT

A hinge covers, guards, or protectors configured for use during painting. The hinge protector for a hinge has a pair of hinge plates and a knuckle. The hinge protector may have an inner cylinder portion, an outer cylinder portion, a pivot rotatably coupling the inner cylinder portion to the outer cylinder portion at one end. The inner cylinder portion and the outer cylinder portion may define an opening for receiving the knuckle of the hinge.

20 Claims, 19 Drawing Sheets

HINGE PROTECTOR

FIELD OF THE INVENTION

This invention is in the field of hinge covers, guards, or protectors, and more specifically to hinge protectors for use during painting.

BACKGROUND

Masking tape is currently being used in the painting industry for covering trim, hinges, doorknobs, or other features where paint is not desired. Typically, each feature is taped prior to painting and then removed once painting is finished. Taping each feature is particularly important during spray painting as a fine mist of paint is sprayed over the area. Features that have not been masked will receive undesirable paint thereon.

One particular problem is masking the hinges of a door and/or window. Masking the hinges may take additional time as these features typically more complicated than masking long pieces of trim. Additionally, as the door or window may need to be opened and closed during painting, the masking tape can pull away from the hinge causing paint from the tape to contact the hinge or causing the hinge to become uncovered when the next coat of paint is applied. This problem causes the painter to spend man-hours cleaning the hinge afterwards.

In some instances, the painter may completely remove the hinges and put them back on after painting. This endeavor is time consuming and if the doors are to be painted the same color as the walls and/or trim, this results in the painter being unable to paint the doors and the walls/trim simultaneously.

SUMMARY OF THE INVENTION

According to an aspect, there is provided a hinge protector for a hinge having a pair of hinge plates and a knuckle. The may comprise an inner cylinder portion; an outer cylinder portion; and a pivot rotatably coupling the inner cylinder portion to the outer cylinder portion at one end. The inner cylinder portion and the outer cylinder portion may define an opening for receiving the knuckle of the hinge. The outer cylinder portion may have a larger diameter than the inner cylinder portion. The outer cylinder portion may comprise half a circumference of the hinge protector. The outer cylinder portion may comprise a raised elongate edge. The inner cylinder portion may comprise more than half of the circumference of the hinge protector. One or more ends of the inner cylinder may be closed.

In some aspects, the pivot may comprise a protrusion extending from the closed end of the inner cylinder portion and a connector for coupling to the protrusion and extending from the outer cylinder portion. The connector may be selected from a C-shaped connector or a circular connector. The connector may extend from the outer cylinder using a pair of arms.

According to some aspects, the hinge protector may comprise a stop protrusion extending from the closed end of the inner cylinder portion. The stop protrusion may contact at least a portion of the outer cylinder portion.

In some other aspects, the at least one closed end of the inner cylinder portion may comprise a hole for receiving an elongate rod having a length approximately equal to a length of the inner cylinder portion. The elongate rod and the inner cylinder portion may define an opening for receiving one of the hinge plates.

In some aspects, the hinge protector may comprise an arcuate flange extending outward radially from the outer cylinder from at least one end. A hook protrusion may extend from the arcuate flange into the opening for receiving the knuckle of the hinge; the hook protrusion hanging over one of the hinge plates. The stop protrusion may comprise a flexible elbow coupled to an overhang on the opening formed by the inner cylinder portion and the outer cylinder portion; the overhang retains the inner cylinder portion to one of the hinge plates. The flexible elbow may extend from a top or a side of the arcuate flange and couples to the hook protrusion. Some aspects may comprise an opposing hook protrusion extending from the other end.

According to another aspect, the hinge protector may comprise an elongate guide defining an elongate opening along an edge of the inner cylinder portion. The elongate opening may receive one of the hinge plates.

In some aspects, an end cap may be configured to couple to an end of the inner cylinder portion. The end cap may comprise a hole for aligning with a protrusion at an end of the elongate guide.

In yet another aspect, the hinge protector may comprising a retaining protrusion extending from the arcuate flange on the outer cylinder portion. The retaining protrusion may define an elongate opening for receiving one of the hinge plates. A retaining beam may couple to the retaining protrusion to hold the outer cylinder portion to one of the hinge plates.

DESCRIPTION OF THE DRAWINGS

While the invention is claimed in the concluding portions hereof, example embodiments are provided in the accompanying detailed description which may be best understood in conjunction with the accompanying diagrams where like parts in each of the several diagrams are labeled with like numbers, and where:

DETAILED DESCRIPTION OF THE ILLUSTRATED EMBODIMENTS

Figure 1:
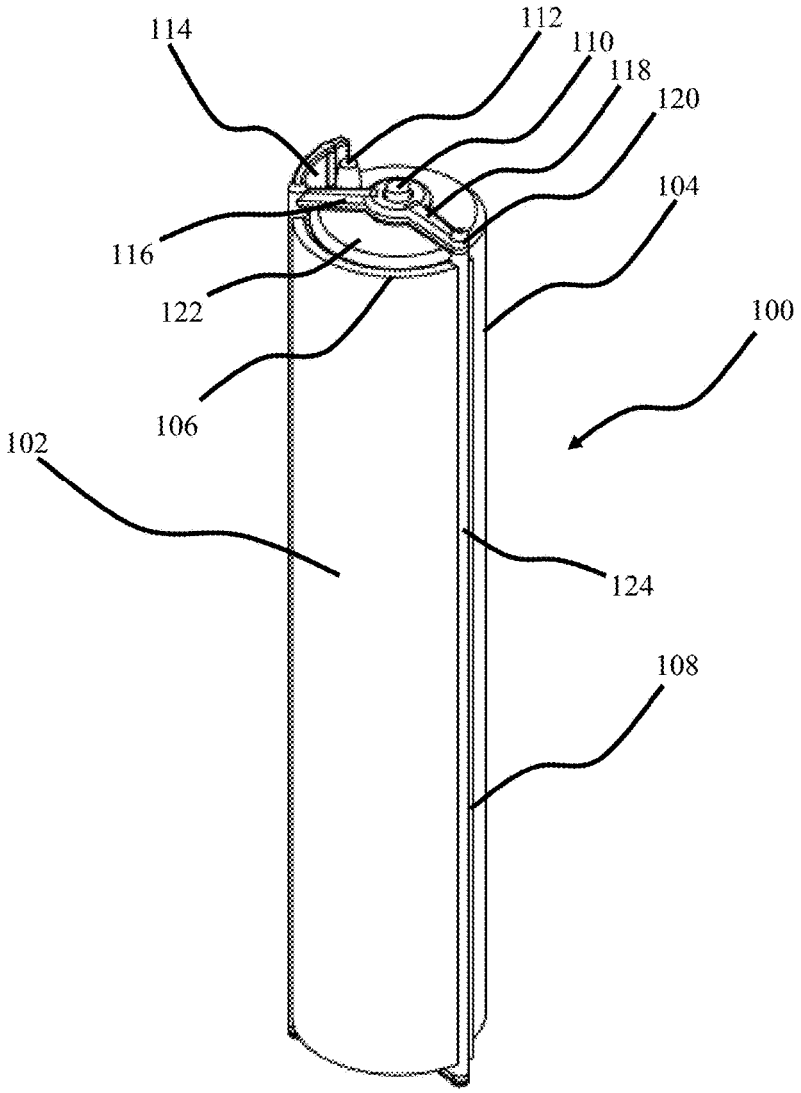
FIG. 1 is a perspective top left side view of a hinge protector in a closed position.
Figure 2:
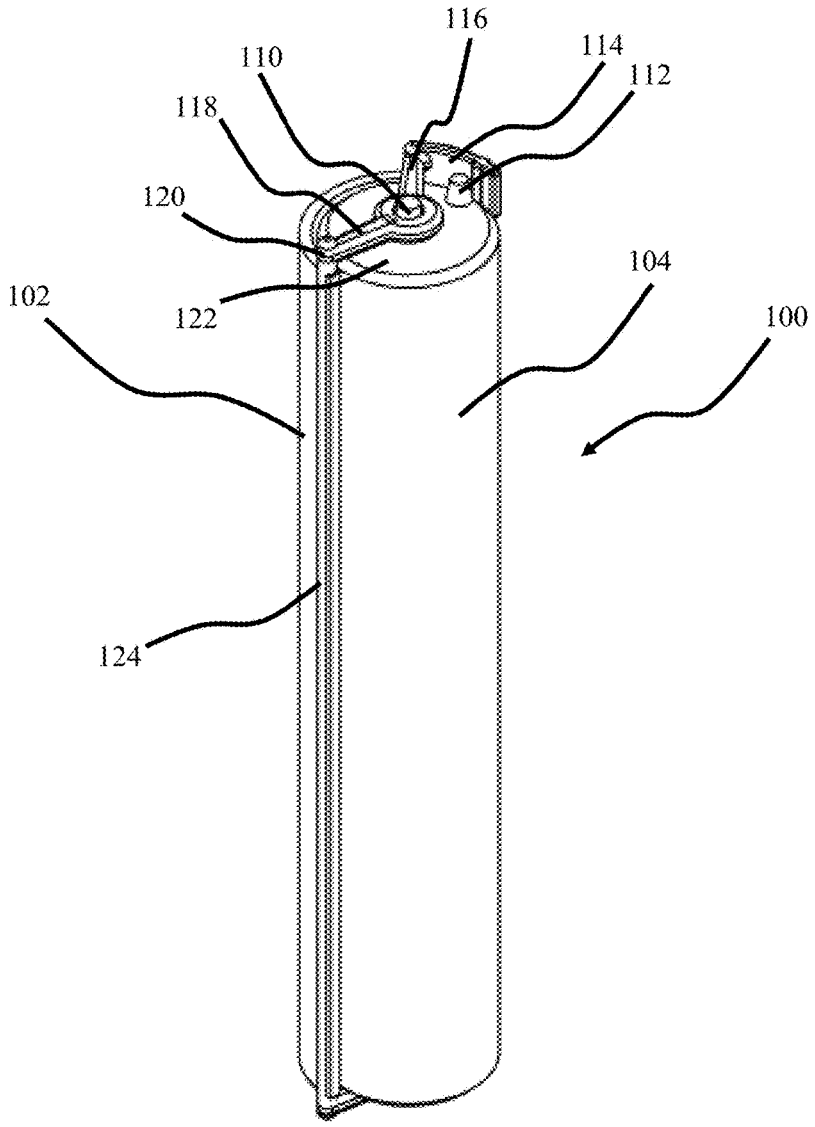
FIG. 2 is a perspective top right side view of the hinge protector of FIG. 1.
Figure 3:
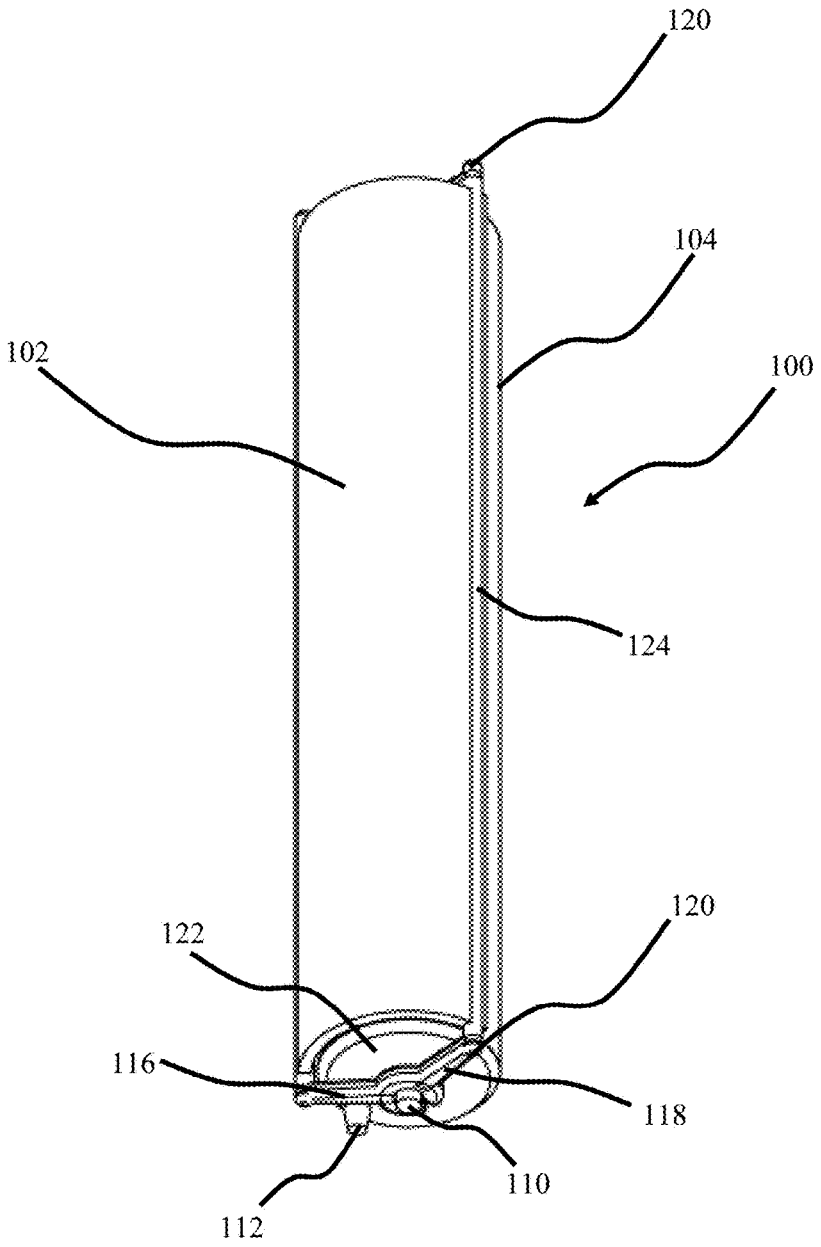
FIG. 3 is a perspective bottom left side view of the hinge protector of FIG. 1.
Figure 4:
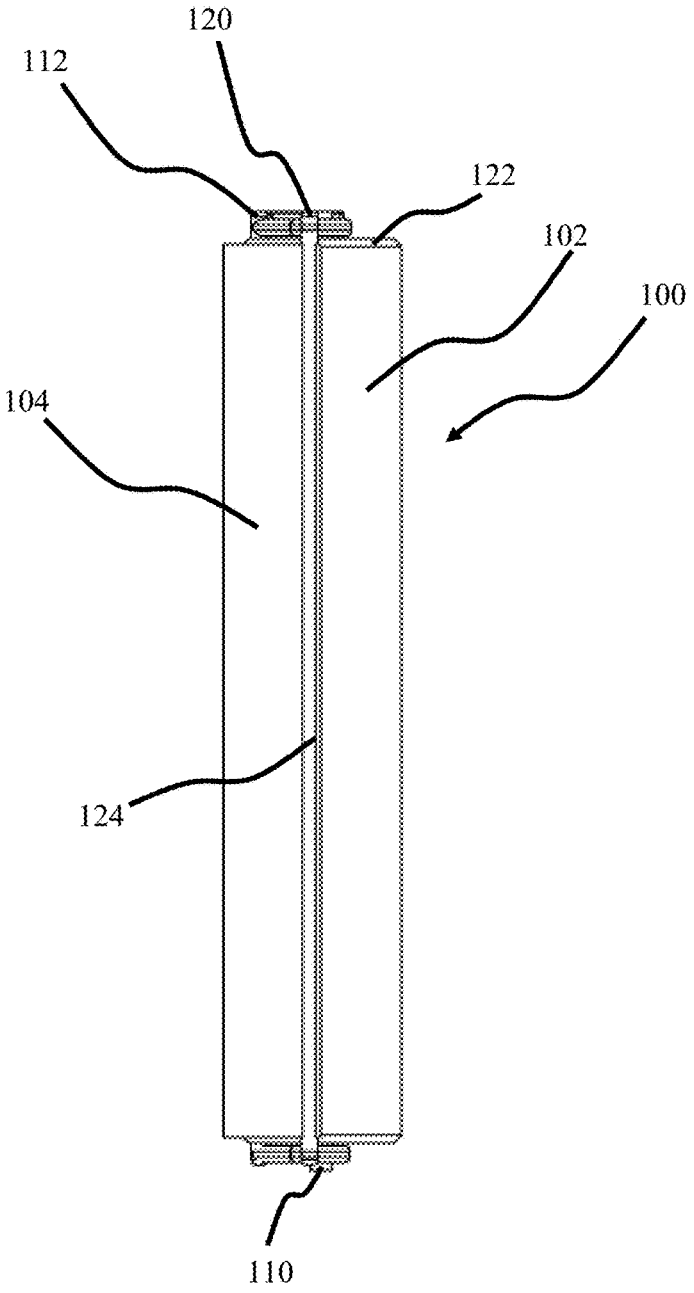
FIG. 4 is a front plan view of the hinge protector of FIG. 1.
Figure 5:
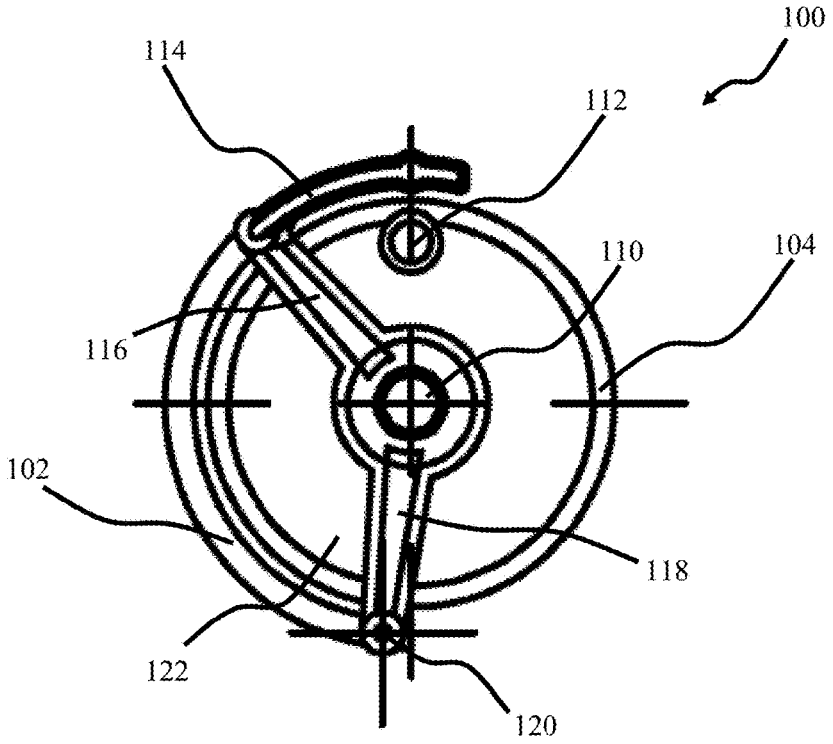
FIG. 5 is a top plan view of the hinge protector of FIG. 1.
Figure 6:
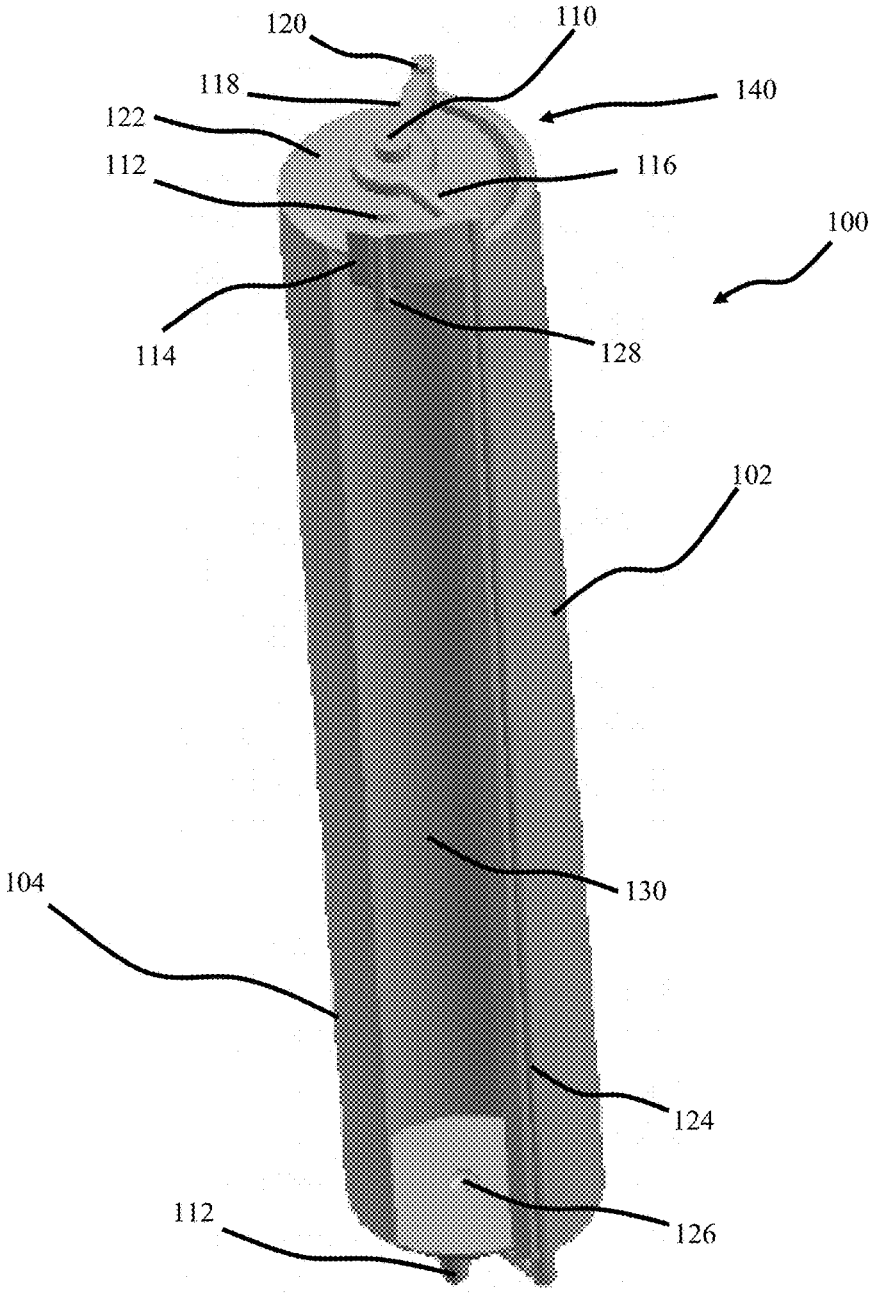
FIG. 6 is a rendered perspective top side view of the hinge protector of FIG. 1 in an open position.

In an aspect described herein with reference to FIGS. 1-7, there is provided a hinge protector 100 for covering a hinge 500 of a door (not shown). The hinge 500 generally comprises a pair of plates 504 coupled to a knuckle 502 comprising one or more interleaved cylinders for receiving a hinge pin (not shown). The hinge protector 100 may be constructed from injection molded plastics, rubber, or the like. The hinge protector 100 may generally be cylindrical in shape and comprises a pair of nested cylinder portions 102, 104. In this aspect, the hinge protector 100 comprises a pair of injection molded plastic cylinder portions 102, 104. The outer cylinder portion 102 may generally have a larger diameter than the inner cylinder portion 104. The outer cylinder portion 102 may comprise approximately half of the circumference of the hinge protector 100. The inner cylinder portion 104 may comprise slightly more than approximately half of the circumference of the hinge protector 100 with the opening being approximately the size of the hinge 500 to be placed therein. Solely in order to simplify the language herein, the outer cylinder portion 102 may be referred to as the outer cylinder 102 and the inner cylinder portion 104 may be referred to as the inner cylinder 104. This language does not imply that the cylinders are complete, closed cylinders.

The inner cylinder 104 may be rotatably coupled to the outer cylinder 102 by way of a pivot 110 on each end of the cylinders 102, 104. The pivot 110 may be coupled to the outer cylinder 102 using a pair of arms 116, 118. In the aspect depicted in FIGS. 1-7, the pair of arms 116, 118 (on each end of the outer cylinder 102) may connect the pivot 110 to a corner of where an arcuate portion 106 of the outer cylinder 102 connects to an elongate portion 108 of the outer cylinder 102. In other aspects, the pair of arms 116, 118 may connect the pivot 110 to other points along the arcuate portion 106. By rotating the inner cylinder 104 with respect to the outer cylinder 102, an opening 130 for receiving the knuckle 502 of the hinge 500 may be formed.

Figure 8:
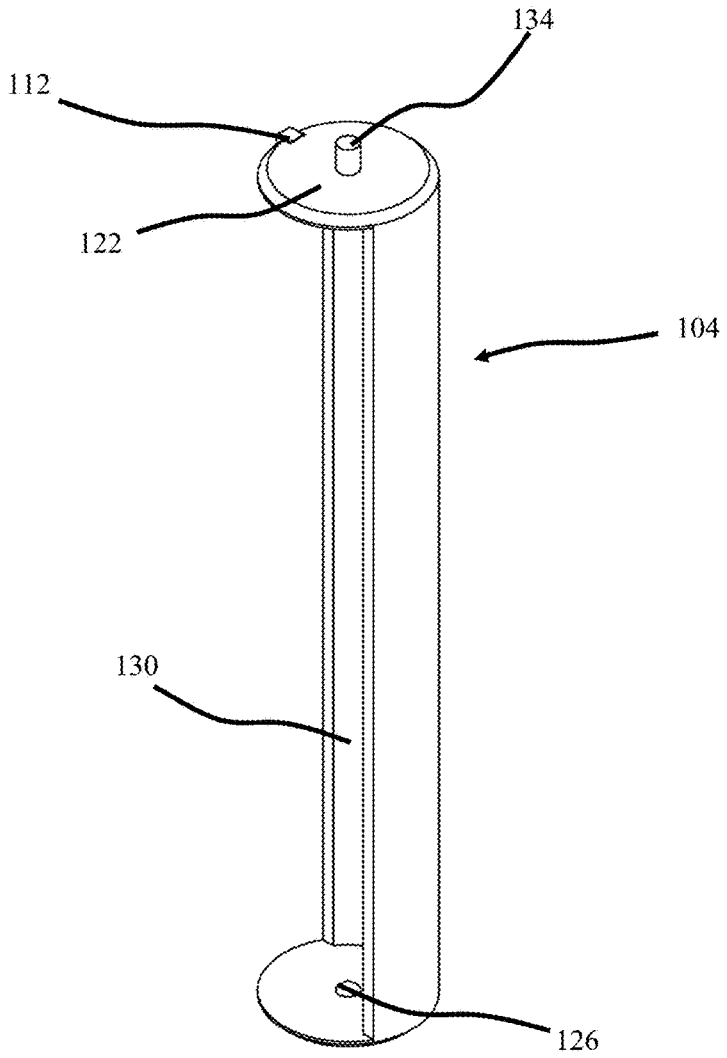
FIG. 8 is a perspective side view of the inner cylinder portion of FIG. 7.
Figure 9:
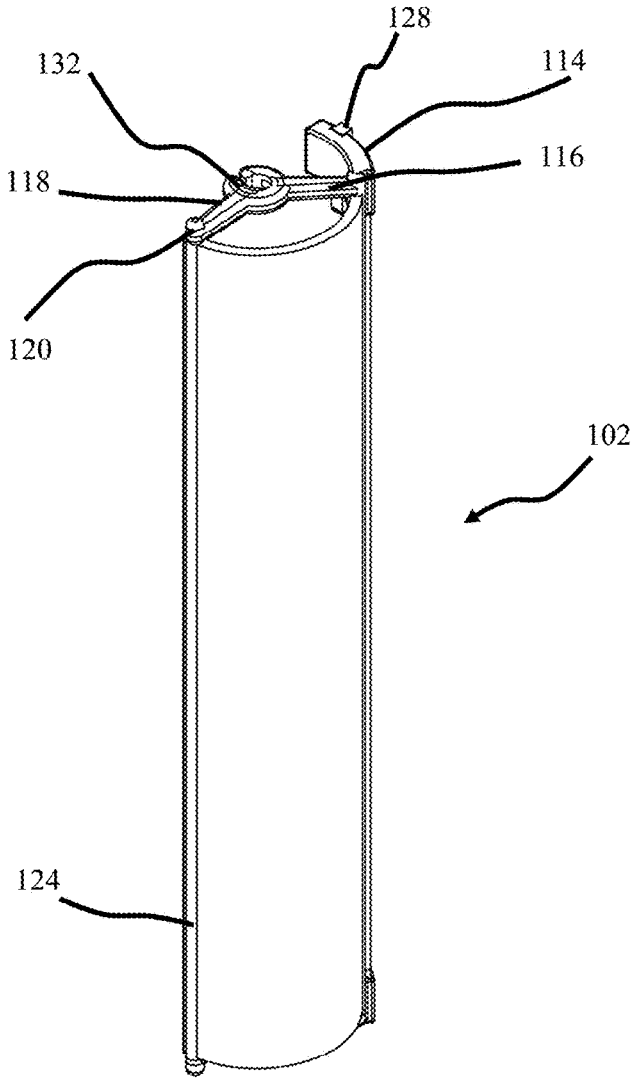
FIG. 9 is a perspective side view of the outer cylinder portion of FIG. 7.

The ends of the inner cylinder 104 may be substantially closed surface 122 in order to protect the hinge 500 within. In some aspects, the edge of the closed portion 122 may be beveled. At the pivot 110, the closed surface 122 may comprise a protrusion 126, visible in FIG. 8, that may snap into the pivot 110 of the outer cylinder 102. An stop protrusion 112 may extend from the closed portion 122 and may contact arm 116 when the hinge protector 100 is in a closed position as depicted in FIG. 1. In this aspect, the stop protrusion 112 may be located on the exterior edge of the closed portion. As the outer cylinder 102 rotates about the pivot 110, the protrusion 112 rotates away from arm 116 to contact arm 118 thereby stopping the rotational motion of the outer cylinder 102. Therefore, the arcuate distance between the pair of arms 116, 118 and traveled by the protrusion 112 generally corresponds to the opening 130 for receiving the hinge 500. In some aspects, the protrusion 112 may be located closer to the pivot 110 in order to reduce the opening 130.

A raised edge 124 may extend along one of the elongate edges of the outer cylinder 102 to facilitate catching paint spray and cause the paint to run away from the edge of the outer cylinder 102 that contacts the hinge 500. An arcuate flange 114 may extends outward from an end 140 of the outer cylinder 102 and generally extend outward from the raised edge 124. A hook protrusion 128 may extend into the opening 130. The hook protrusion 128 may permit the hinge protector 100 to be hung on the top of one half of the hinge 500 and secured in position. The hook protrusion 128 may additionally cause the outer cylinder 102 to rotate along with the door when it is opened or closed. By causing the outer cylinder 102 to rotate along with the door, the hinge 500 may be automatically covered by the hinge protector 100 whether the door is open or closed.

To install the hinge protector 100, the outer cylinder 102 may be rotated about the inner cylinder 104 to place the hinge protector 100 into the open position. The hook protrusion 128 on the top of the hinge protector 100 may be placed over the top of a portion of the hinge 500. The bottom end of the hinge protector 100 may be rotated toward the hinge 500 placing the hinge 500 within the inner cylinder 104. An elastic band may then be placed over the stop protrusions 112.

In another aspect depicted in FIGS. 7-10, similar features are numbered in a corresponding manner as with regard to FIGS. 1-6. In this aspect, the pivot 110 on each end of the hinge protector 100 may comprise a protrusion 134 (in this case a cylindrical-shaped protrusion) extending from the closed surface 122 of the inner cylinder 104 that engages with a C-shaped connector 132 of the outer cylinder 102. The C-shaped connector 132 may be sized such that the protrusion 134 is able to turn easily within the C-shaped connector 132 but still retains the protrusion 110 therein. The C-shaped connector 132 may be connected to the outer cylinder 102 by arms 116, 118. At the end of arm 116, there may be an arcuate flange 114; and at the end of arm 118, there may be a raised edge 124 extending downward on the edge of the outer cylinder 102, both as previously described. In some aspects, the C-shaped connector 132 may be sized so that the protrusion 134 may be removed facilitating easier cleaning of the inner cylinder 104 and outer cylinder 102.

Figure 7:
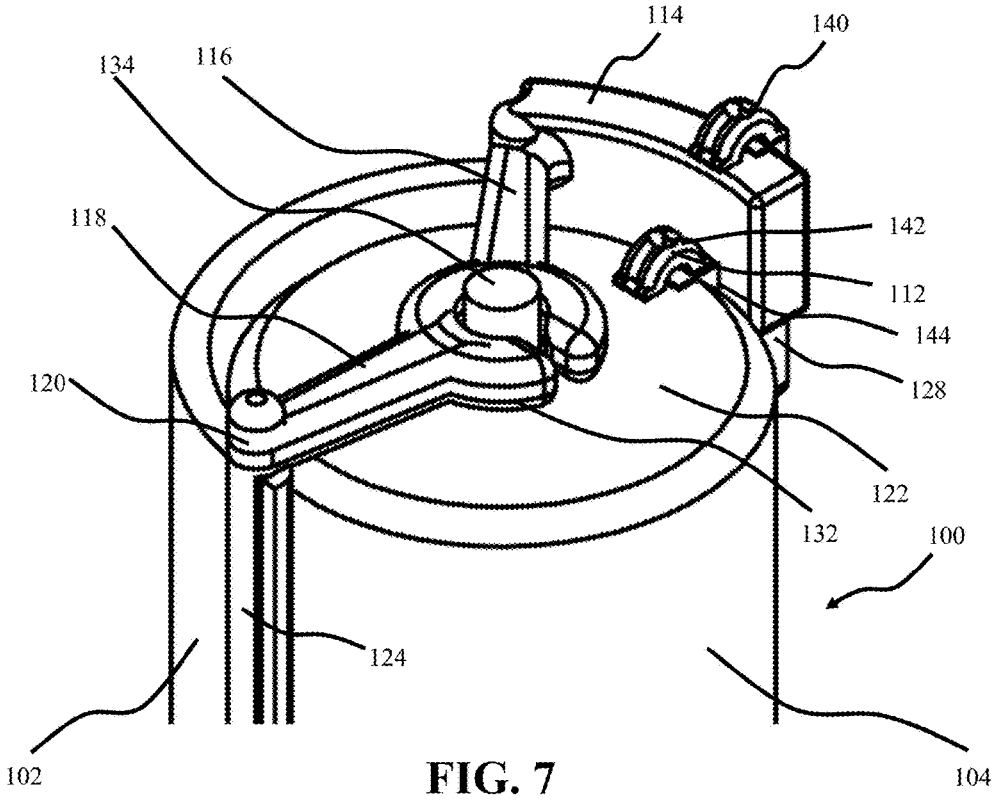
FIG. 7 is a perspective view of the top of a hinge protector in a closed position demonstrating a movable hook.
Figure 10:
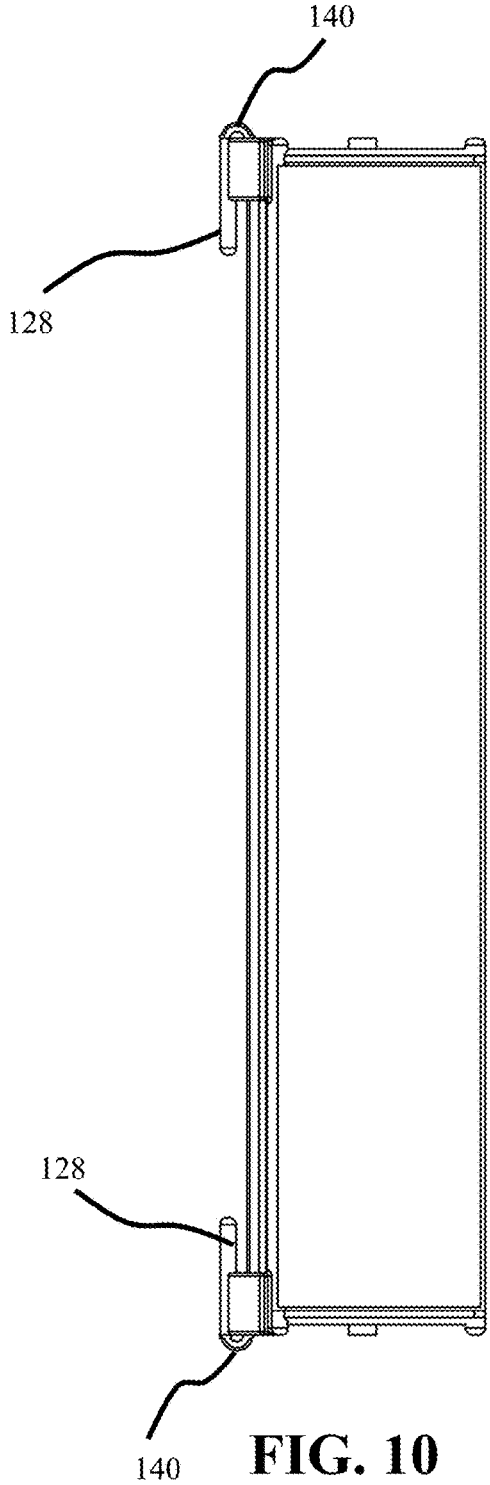
FIG. 10 is a side plan view of the hinge protector of FIG. 7.
Figure 11:
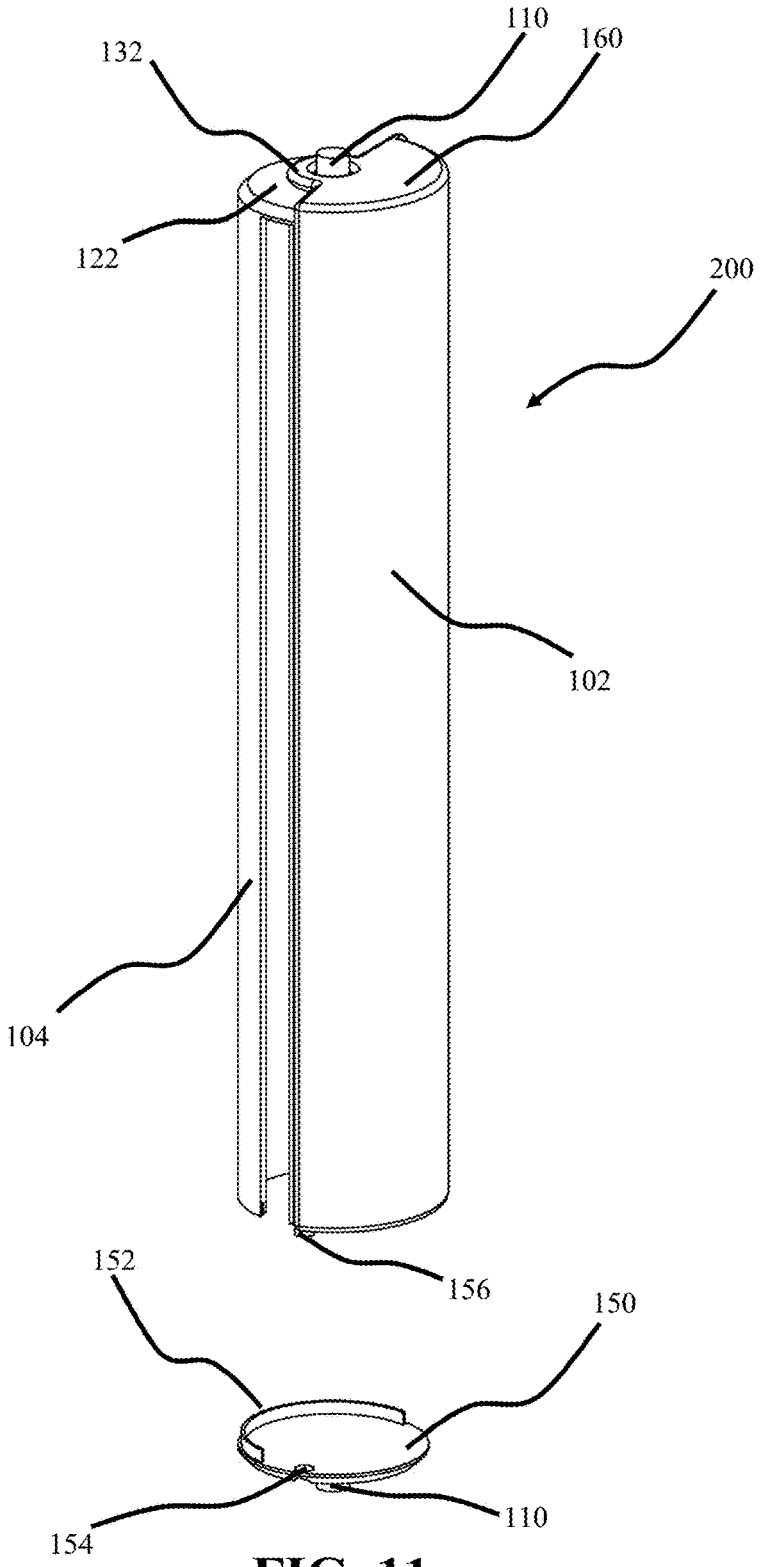
FIG. 11 is a perspective top view of a hinge protector demonstrating a removable end cap.
Figure 12:
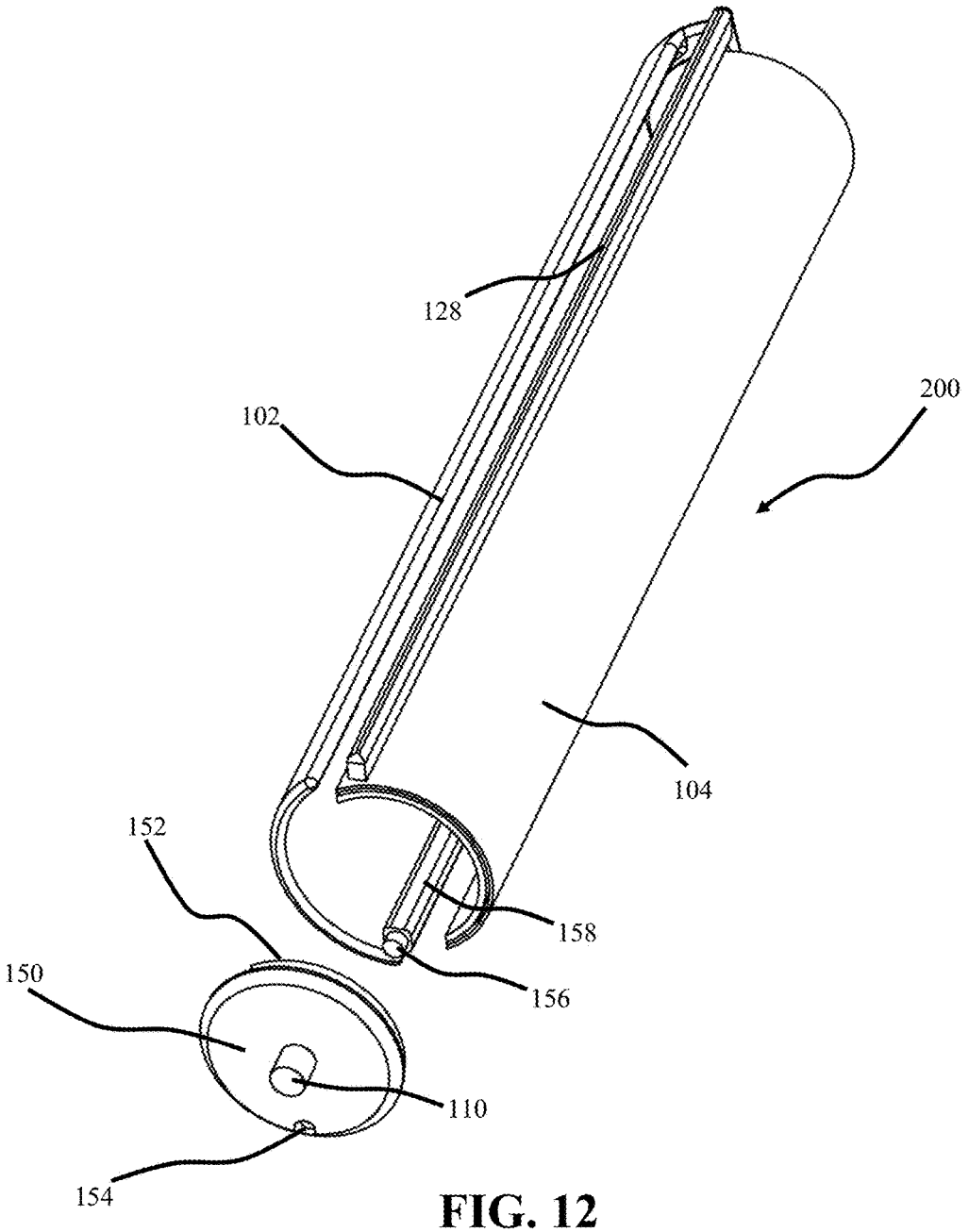
FIG. 12 is a perspective bottom view of the hinge protector of FIG. 11.
Figure 13:
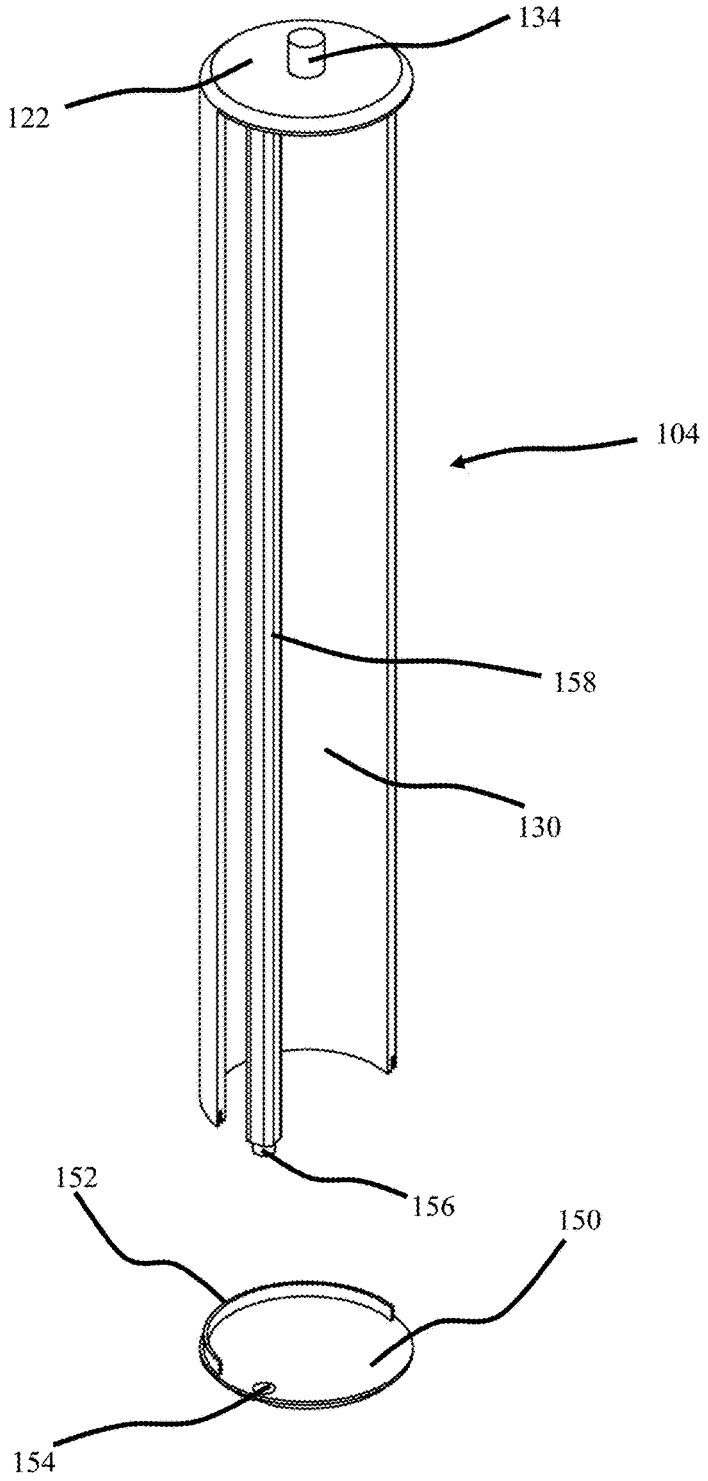
FIG. 13 is a perspective side view of the inner cylinder portion of FIG. 11.
Figure 14:
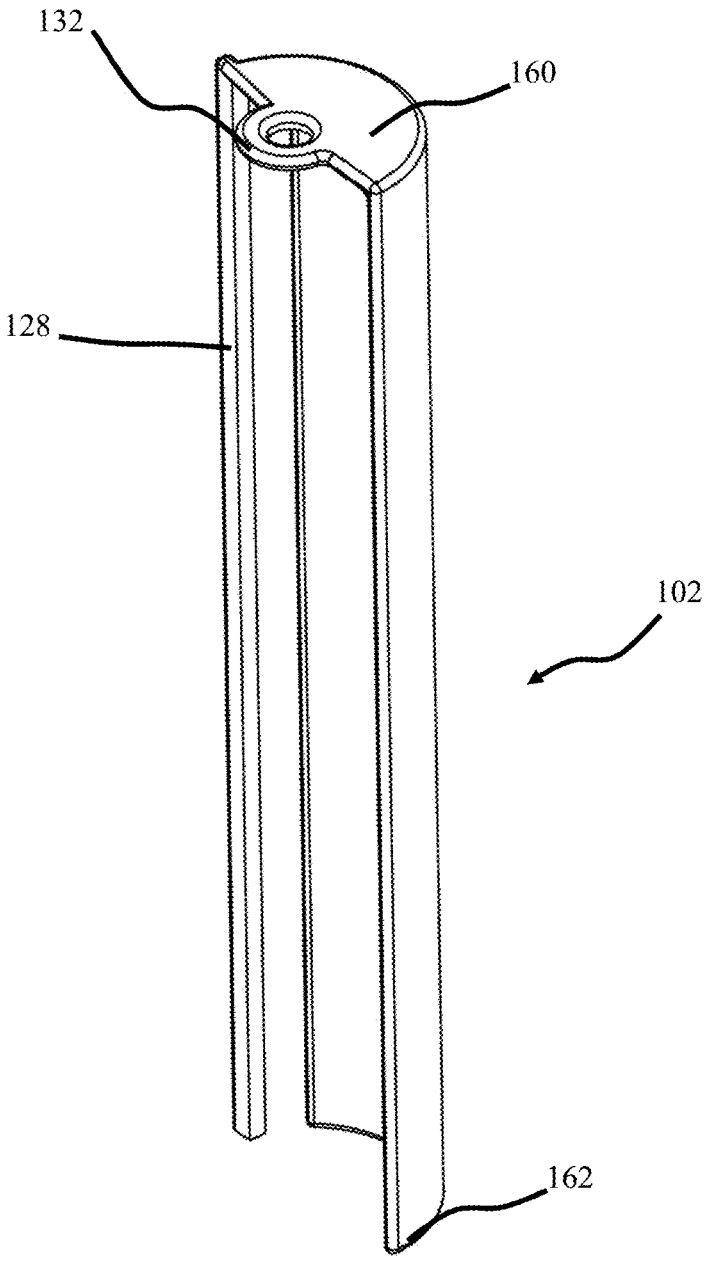
FIG. 14 is a perspective side view of the outer cylinder portion of FIG. 11.
Figure 15:
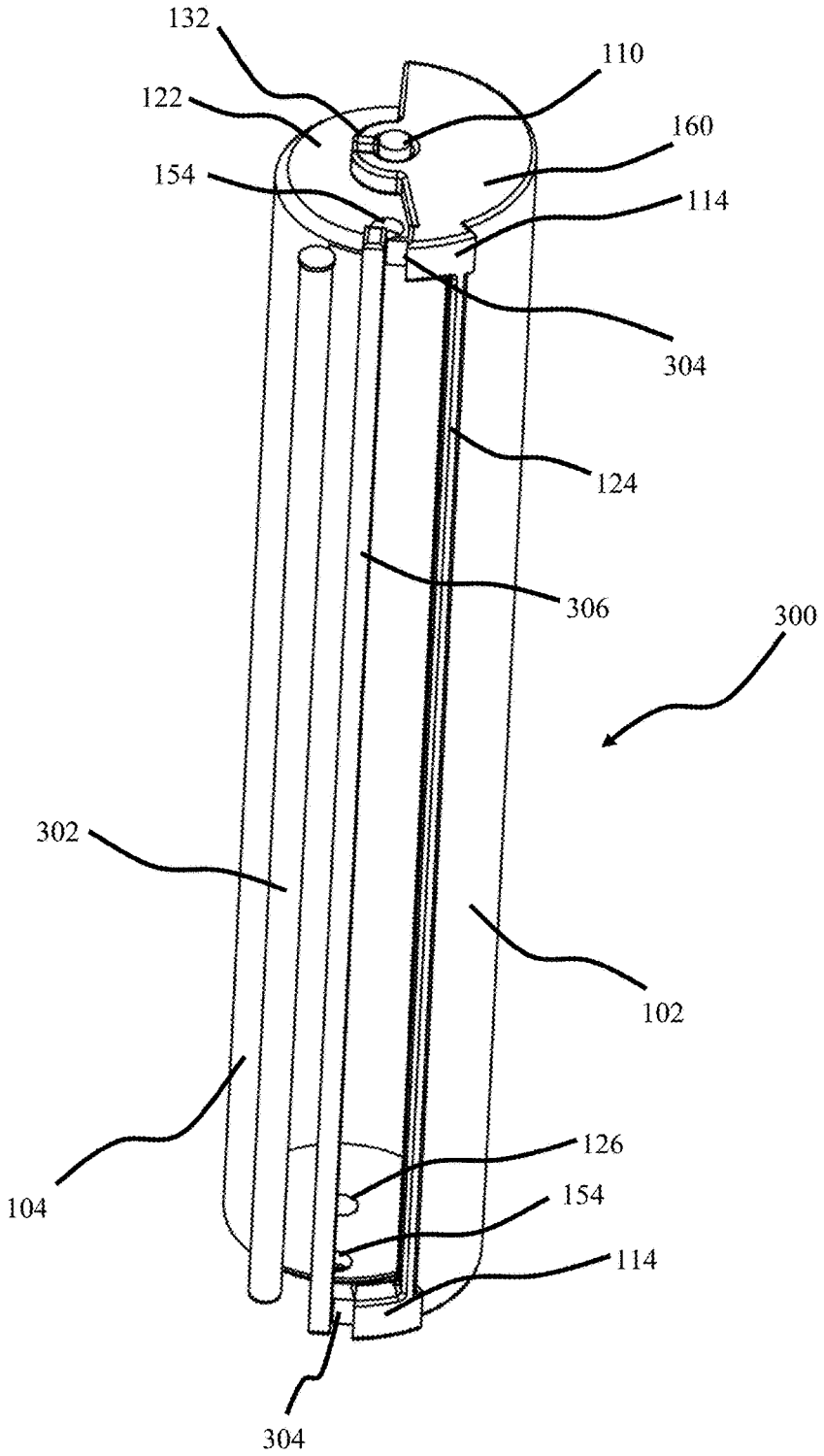
FIG. 15 is a perspective top left view of a hinge protector demonstrating a retaining rod.
Figure 16:
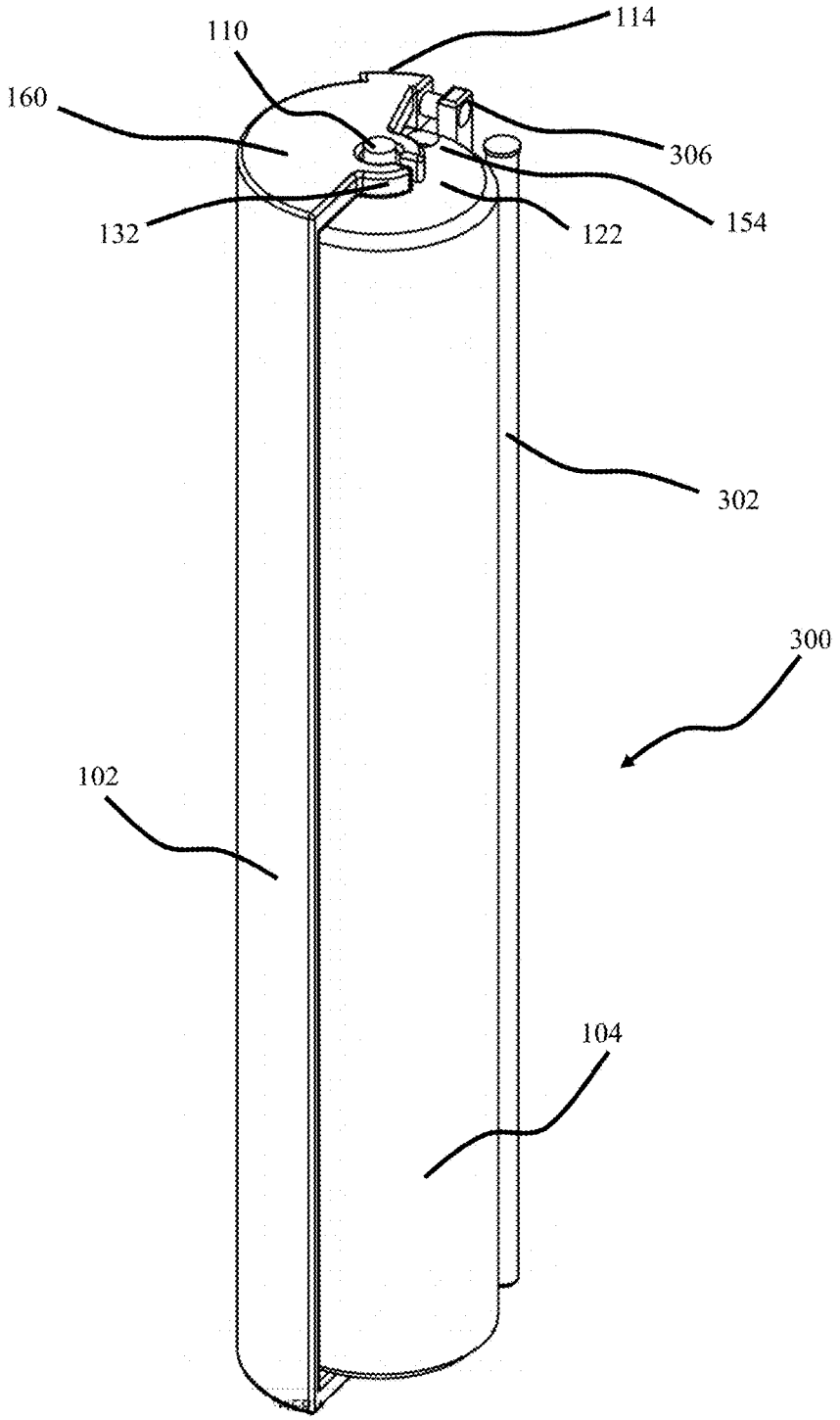
FIG. 16 is a perspective top right view of the hinge protector of FIG. 15.
Figure 17:
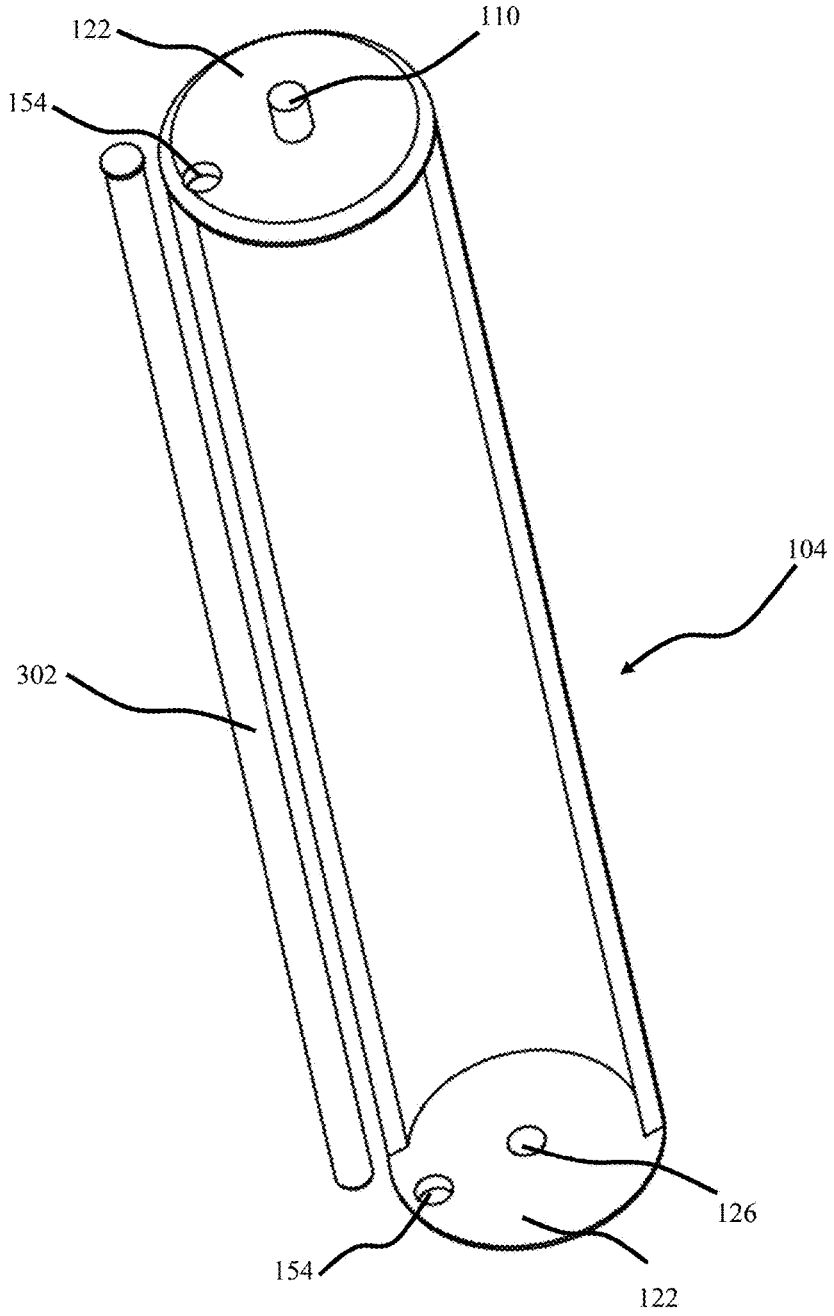
FIG. 17 is a perspective view of the inner cylinder portion of FIG. 15.

In yet another aspect, depicted in FIGS. 7 and 10, the stop protrusion 112 may comprise a flexible elbow or bend 142 that extends from the closed surface 122. The flexible elbow 142 may be coupled to an overhang 144 on the opening 130 formed by the inner cylinder 104 and the outer cylinder 104. The overhang 144 may be used for retaining the inner cylinder 104 to one of the plates 504 of the door hinge 500. The flexible elbow 142 may enable the overhang 144 to be rotated from a downward position to generally outward from the inner cylinder 104 allowing the knuckle 502 of the door hinge 500 to be placed through the opening 130. An opposing overhang 144 may be rotated from an upward position to generally outward from the inner cylinder 104 when being placed over the plate 504 of the door hinge 500. The opposing overhang 144 may then be placed back into the upward position. Since the flexible elbow 142 extends above the closed surface 122, the flexible elbow 142 may also provide the additional function of the stop protrusion 122 as previously described herein.

Similarly, a flexible elbow or bend 140 may extend from the top or side of the arcuate flange 114 and may be coupled to the hook protrusion 128. As previously described, the hook protrusion 128 may extend downward into the opening 130. On the other end of the hinge protector 100, an opposing hook protrusion 128 may extend upward into the opening 130. The hook protrusion 128 at the top end may permit the hinge protector 100 to be hung on the top of one half of the hinge 500. The opposing hook protrusion 128 at the bottom of the hinge protector 100 may be rotated to be generally horizontal permitting the opposing hook protrusion 128 to be placed over the bottom of the door hinge 500. The opposing hook protrusion 128 may then be returned to the upward configuration retaining the outer cylinder 102 to the door hinge 500.

In yet another aspect 200, depicted in FIGS. 11 to 14 and 19, similar features are numbered in a corresponding manner as with regard to FIG. 1-6 or 7-10. In this aspect, the inner cylinder portion 104 may comprise an elongate guide 158 defining an elongate opening along an edge of the inner cylinder portion 104. The plate 504 of the hinge 500 may be slid into the elongate opening until the edge of the plate 504 reaches the substantially closed surface 122. An end cap 150 may then be friction fitted (e.g. snapped) into the inner cylinder portion 104 by aligning a hole 154 in the end cap 150 with a corresponding protrusion 156 at an end of the elongate guide 158. The end cap 150 may have a raised edge 152 corresponding to the opening member 130. The outer cylinder portion 102 may then slide the circular connector 132 over the pivot 110. Rather than using the pair of arms 116, 118, the end of the outer cylinder portion 102 may comprise a closed end 160. Also in this aspect, the hook protrusion 128 may extend the full length of the outer cylinder portion 102 so as the define an elongate opening where the plate 504 of the hinge 500 may be slid. In some aspects, a bottom end 162 of the outer cylinder portion 102 may be open ended or may comprise protrusions (not shown) to hold the outer cylinder portion 102 to the end cap 150 of the inner cylinder portion 104. In this aspect, the hole 154 may extend completely through the end cap 150 or only extend into the end cap 150.

Turning now to FIGS. 15 to 18, another aspect 300 is depicted. Again, similar features are numbered in a corresponding manner as with regard to FIG. 1-6 or 11-14. In this aspect, the inner cylinder portion 104 may be placed over the knuckle 502 (and pin) of the hinge 500 and may be rotated until the edge meets one of the plates 504 of the hinge 500. A rod 302 may be inserted through a pair of holes 154 in the closed ends 122 of the inner cylinder portion 104. The rod 302 may retain the inner cylinder portion 104 to the hinge 500. The rod 302 may comprise a lip around at least one of the ends that may be of a larger diameter than the pair of holes 154 and may retain the rod 302 within at least one of the holes 154.

Figure 18:
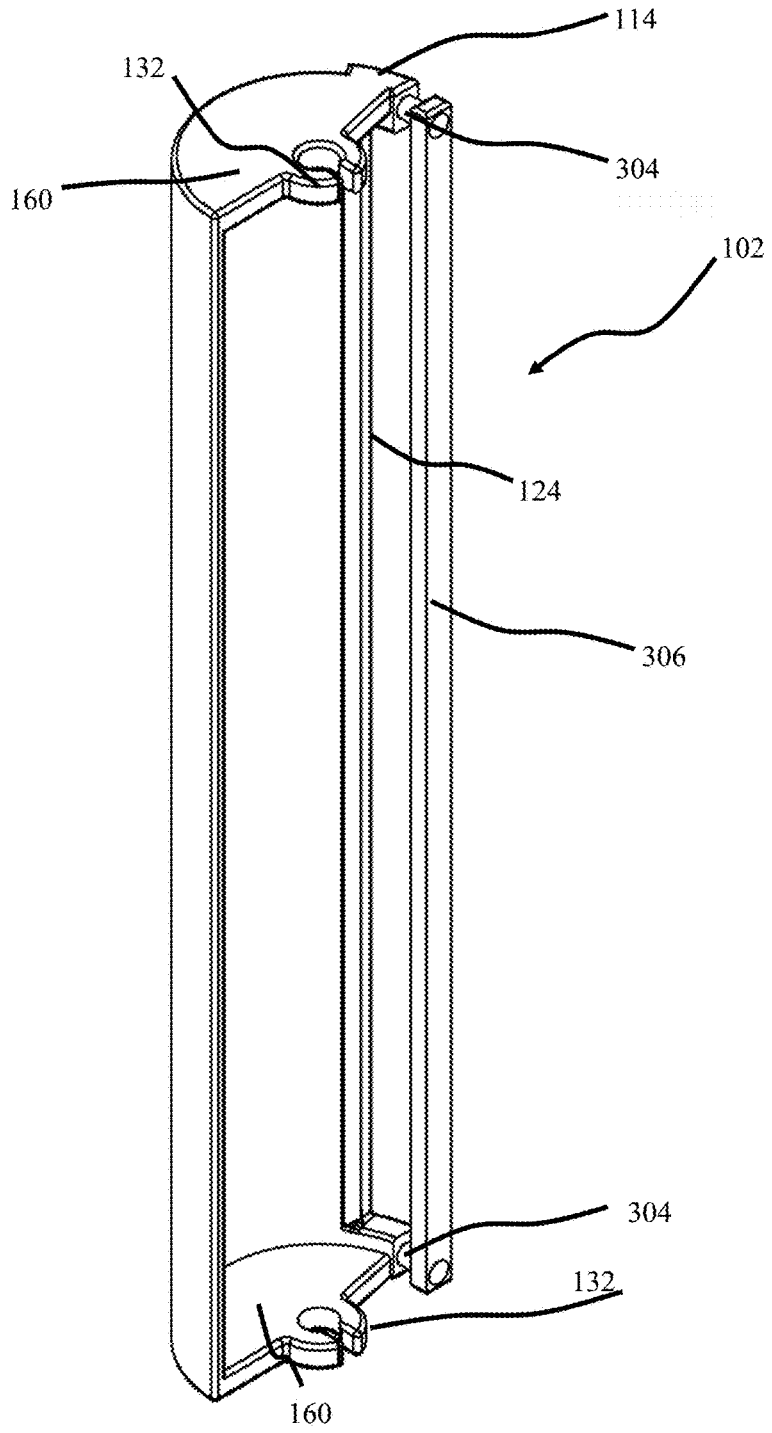
FIG. 18 is a perspective view of the outer cylinder portion of FIG. 15.
Figure 19:
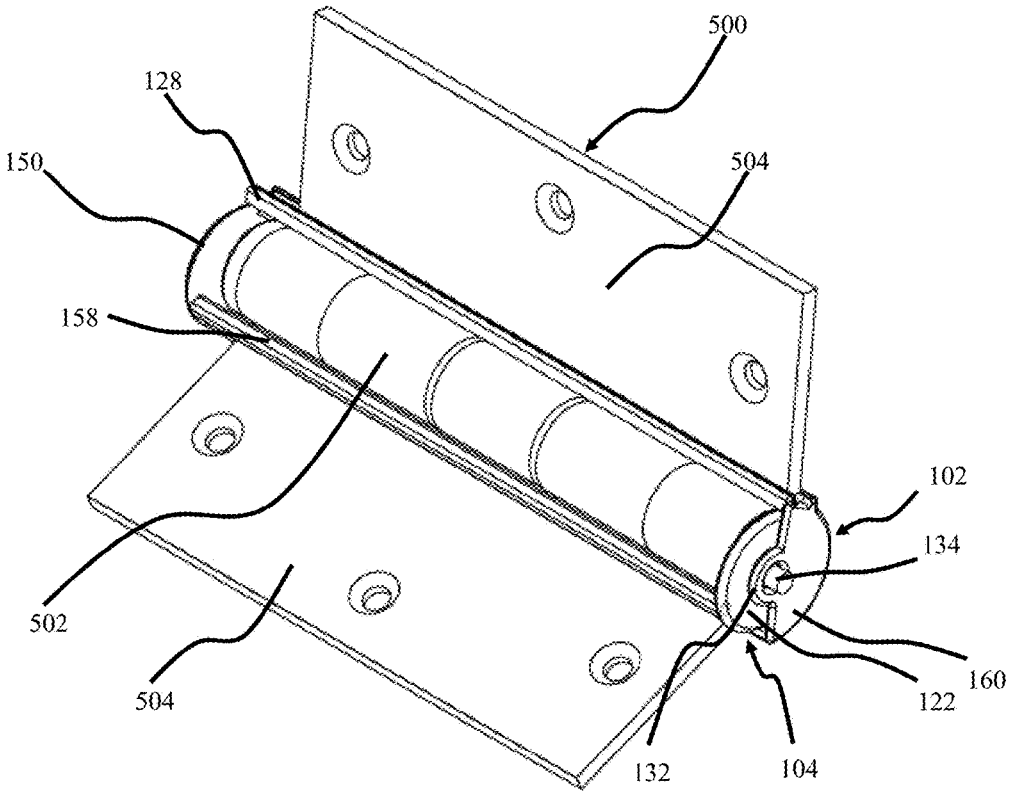
FIG. 19 is a perspective view of the hinge protector installed on a hinge according to FIGS. 11-14.

The outer cylinder portion 102, shown more clearly in FIG. 18, may then slide the circular connector 132 over the pivot 110 on one end and snap the other circular connector 132 onto the other pivot 110. The outer cylinder portion 102 may comprise an arcuate flange 114 that may overhang a raised edge 124. A protrusion 304 may extend from the arcuate flange 114 on each end of the outer cylinder portion 102. The protrusions 304 may be used for coupling to a retaining beam 306. The outer cylinder portion 102 may be placed over the hinge 500 and rotated until the arcuate flange 114 and/or the protrusions 304 extend past the plate 504 of the hinge 500. The retaining beam 306 may then attached to the protrusions 304 holding the outer cylinder portion 102 to the hinge 500.

In another aspect, the overhang 144 may further comprise a retainer (not shown) for holding the overhang 144 in a generally aligned to the exterior of the inner cylinder 104. Similarly, the hook protrusion 128 may also comprise a retainer (not shown) for holding the hook protrusion 128 against the arcuate flange 114. These retainers (not shown) may permit the overhang 144 and/or the hook protrusion 128 to be unsnapped and permit rotation to a generally perpendicular position with respect to the curved surface of the inner cylinder and/or the outer cylinder 102.

Although only one end of the cylinders 102, 104 are described herein, it is understood that the other end of the cylinders 102, 104 may operate in the same or similar manner.

In some aspects, an elastic band (not shown) may be placed over the stop protrusions 112 on each end of the outer cylinder 102 to further secure the hinge protector 100 in position on the hinge 500.

Although the aspects described above have a passive pivot 110, other aspects may comprise an active pivot 110 featuring a torsional spring causing the hinge protector 100 to default to the closed position and/or remain attached with the movement of the door.

Although the aspects described herein may relate to painting applications, other aspects may apply to hinge protectors 100 for preventing dust and/or debris from entering the hinge 500.

The foregoing is considered as illustrative only of the principles of the invention. Further, since numerous changes and modifications will readily occur to those skilled in the art, it is not desired to limit the invention to the exact construction and operation shown and described, and accordingly, all such suitable changes or modifications in structure or operation which may be resorted to are intended to fall within the scope of the claimed invention.

The invention claimed is:

1. A hinge protector for a hinge having a pair of hinge plates and a knuckle, the hinge protector comprising:

an inner cylinder portion;

an outer cylinder portion;

a pivot located at a pivot end of the hinge protector, the pivot rotatably coupling the inner cylinder portion to the outer cylinder portion; and the inner cylinder portion and the outer cylinder portion defining an opening for receiving the knuckle of the hinge.

2. The hinge protector according to claim 1, wherein the outer cylinder portion has a larger diameter than the inner cylinder portion.

3. The hinge protector according to claim 1, wherein the outer cylinder portion comprises half a circumference of the hinge protector.

4. The hinge protector according to claim 1, wherein the outer cylinder portion comprises a raised elongate edge.

5. The hinge protector according to claim 1, wherein the inner cylinder portion comprises more than half of the circumference of the hinge protector.

6. The hinge protector according to claim 1, wherein the inner cylinder portion comprises a closed end.

7. The hinge protector according to claim 6, wherein the pivot comprises a protrusion extending from the closed end of the inner cylinder portion and a connector for coupling to the protrusion and extending from the outer cylinder portion.

8. The hinge protector according to claim 7, wherein the connector is selected from a C-shaped connector or a circular connector.

9. The hinge protector according to claim 7, wherein the connector is extends from the outer cylinder portion using a pair of arms.

10. The hinge protector according to claim 6, further comprising a stop protrusion extending from the closed end of the inner cylinder portion; the stop protrusion contacting at least a portion of the outer cylinder portion.

11. The hinge protector according to claim 10, further comprising an arcuate flange extending outward radially from at least one end of the outer cylinder portion.

12. The hinge protector according to claim 11, further comprising a hook protrusion extending from the arcuate flange into the opening for receiving the knuckle of the hinge; the hook protrusion hanging over one of the hinge plates.

13. The hinge protector according to claim 12, wherein the stop protrusion comprises a flexible elbow coupled to an overhang on the opening formed by the inner cylinder portion and the outer cylinder portion; the overhang retains the inner cylinder portion to one of the hinge plates.

14. The hinge protector according to claim 13, wherein the flexible elbow extends from a top or a side of the arcuate flange and couples to the hook protrusion.

15. The hinge protector according to claim 14, further comprising an opposing hook protrusion extending from the other end of the outer cylinder portion.

16. The hinge protector according to claim 6, wherein the closed end of the inner cylinder portion comprises a hole for receiving an elongate rod having a length approximately equal to a length of the inner cylinder portion; the elongate rod and the inner cylinder portion defining an opening for receiving one of the hinge plates.

17. The hinge protector according to claim 11, further comprising a retaining protrusion extending from the arcuate flange on the outer cylinder portion; the retaining protrusion defining an elongate opening for receiving one of the hinge plates; and a retaining beam coupling to the retaining protrusion to hold the outer cylinder portion to one of the hinge plates.

18. The hinge protector according to claim 1, further comprising an elongate guide defining an elongate opening along an edge of the inner cylinder portion; the elongate opening receiving one of the hinge plates.

19. The hinge protector according to claim 18, further comprising an end cap configured to couple to the inner cylinder portion opposite to the pivot end.

20. The hinge protector according to claim 19, wherein the end cap comprises a hole for aligning with a protrusion at an end of the elongate guide.

* * * * *